US005823563A

United States Patent [19]

Dubuque

[11] Patent Number: 5,823,563

[45] Date of Patent: Oct. 20, 1998

[54] TELEMARK SKI BINDING INCLUDING A CRAMPON

[76] Inventor: Armond K. Dubuque, 3920 138th St. S. E., Sultan, Wash. 98294

[21] Appl. No.: 795,068

[22] Filed: Feb. 5, 1997

[51] Int. Cl.[6] ..... A63C 9/04

[52] U.S. Cl. ..... 280/615; 36/62; 280/618; 280/620

[58] Field of Search ..... 280/613, 615, 280/618, 619, 620, 14.2; 36/117.2, 134, 62, 67 D

[56] References Cited

U.S. PATENT DOCUMENTS

| | | | |
|---|---|---|---|
| 2,152,527 | 3/1939 | Bertrand | 280/615 |
| 2,546,694 | 3/1951 | Johansen | 280/619 |
| 3,229,389 | 1/1966 | Adams | 36/62 X |
| 3,424,470 | 1/1969 | Voster | 280/615 |
| 5,069,463 | 12/1991 | Baud et al. | 280/14.2 |
| 5,156,644 | 10/1992 | Koehler et al. | 280/14.2 |
| 5,689,901 | 11/1997 | Bell et al. | 36/62 X |

*Primary Examiner*—J. J. Swann
*Assistant Examiner*—Michael Mar
*Attorney, Agent, or Firm*—Robert W. Jenny

[57] ABSTRACT

There are two assemblies in the binding, a harness assembly and an attachment assembly. The harness assembly attaches to a ski boot and has a toe fitting which fits over the toe of the boot and has a flat metal plate contacting the toe portion of the sole of the boot. Four sharp pointed posts extend downward from the plate. Each post has a groove near its base, perpendicular to the axis of the post. The attachment assembly attaches to the ski and has latch bars which engage the grooves in the posts to attach the attachment assembly and ski to the harness and ski boot. One latch bar is spring loaded toward the other and as the posts are inserted onto the attachment assembly the spring loaded bar is moved to allow the posts to pass. When the posts are fully inserted the spring loaded bar moves to capture the posts. There is a lever operated cam at the forward end of the attachment assembly which is used to separate the latch bars to enable detaching the ski from the harness. With the ski and attachment assembly removed, the sharp posts serve the crampon function.

1 Claim, 3 Drawing Sheets

FIG. 1
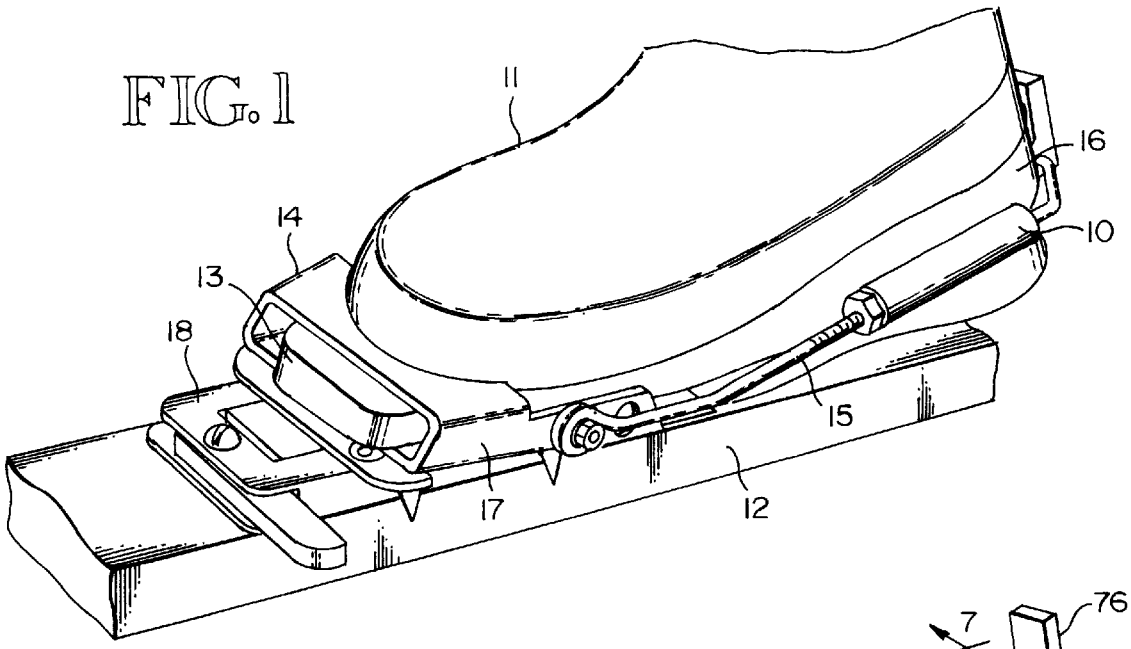
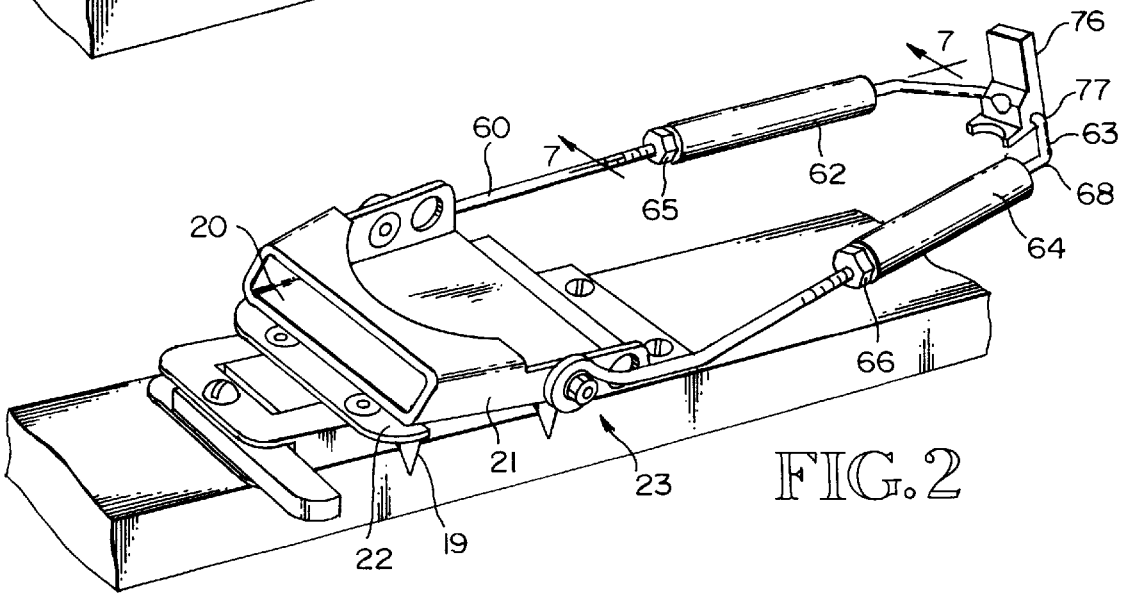
FIG. 2
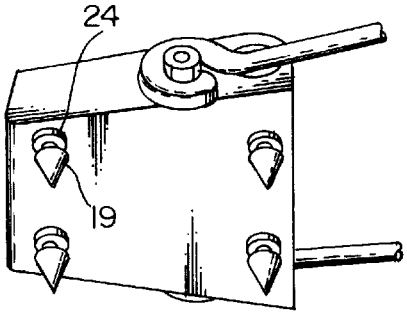
FIG. 3
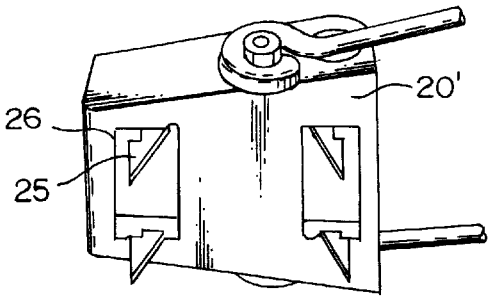
FIG. 3A

FIG. 4
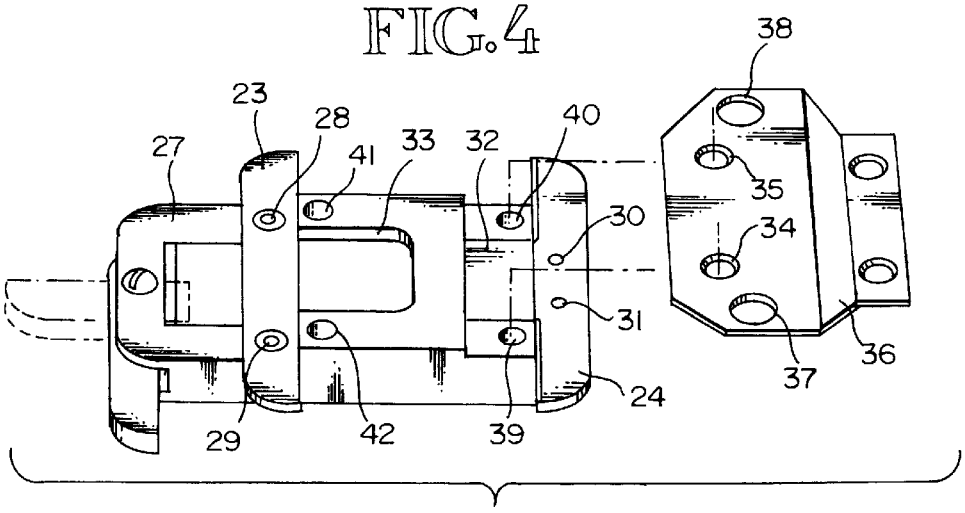
FIG. 5
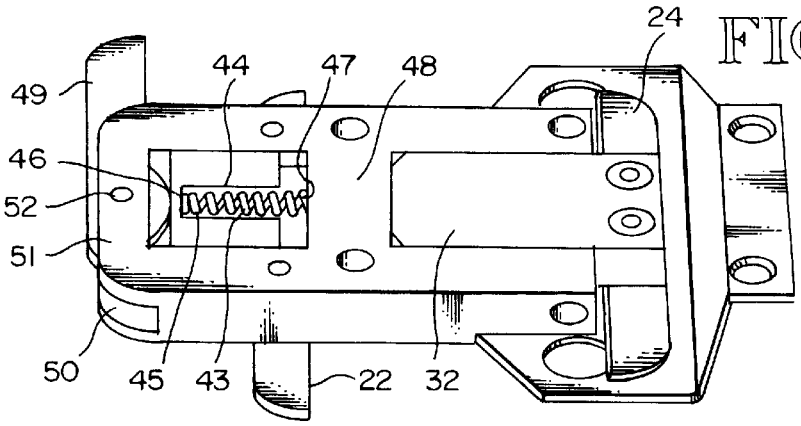
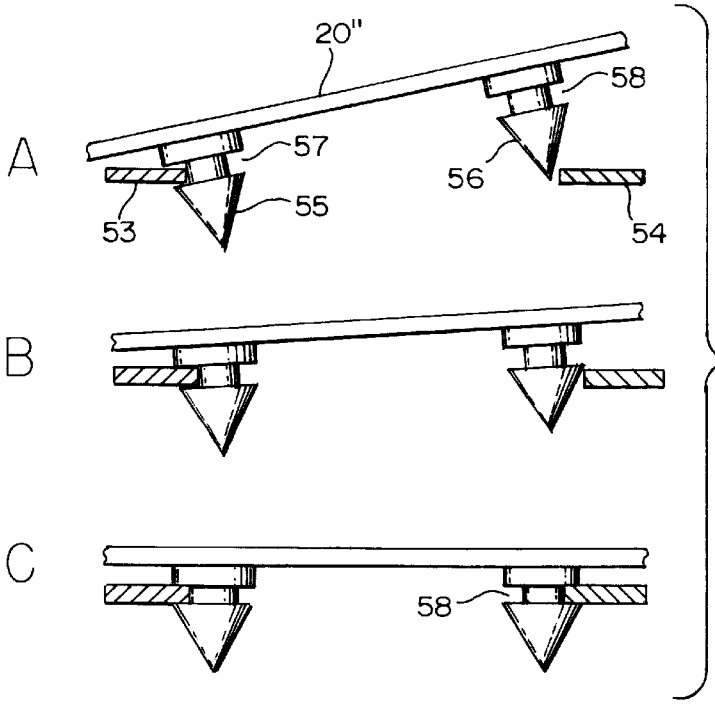
FIG. 6

TELEMARK SKI BINDING INCLUDING A CRAMPON

Disclosure Statement 410,509 has been filed related to the subject invention.

BACKGROUND OF THE INVENTION

1. Field

The subject invention is in the fields of equipments used for skiing and for walking on slippery terrain, specifically telemark ski harness and crampons. For the record, telemark ski harnesses attach the toes of ski boots to skis, allowing the heels of the boots to move up and down and crampons are metal plates fastenable onto the soles of shoes and having sharp protuberances which provide traction on slippery materials such as packed snow and ice.

2. Prior Art

In the subject invention the ski harness utilizes sharp protuberances as part of the mechanism for attaching the harness to the ski in a way such that when the ski is removed the protuberances on the harness function as a crampon. The inventor of the subject invention made a diligent search of the prior art in the two fields, noted above, patented or not, and is not aware of prior art ski bindings which incorporate crampons.

However, it is well recognized that in certain skiing situations, particularly during cross country skiing, It is occasionally good practice, desirable, more effective or even essential for safety reasons to remove skis and replace them with crampons. Using this good practice and safety procedure is deterred by the need to carry the crampons and to completely remove the ski harness to make room for the crampons which require time, energy and are inconvenient to install.

Also, conventional telemark bindings incorporate tension springs in a heel holding assembly that extends around the heel of the ski boot to hold the boot in the toe assembly of the binding. It is commonly known that these springs can be bent and/or over extended to the point that the binding is unsafe or useless. Further, harnesses comprising tension springs and flexible cable tend to allow the user's front to swing laterally somewhat relative to the ski, with the toe of the boot pivoting in the toe plate. Such lateral freedom is undesirable and degrades ski control, increases with conventional harnesses when the tension springs are over stressed. Such over stressing also causes the bindings to release too easily.

Accordingly, to encourage and facilitate the good and safe practice of using crampons when skis are removed, a primary objective of the subject invention is to provide a ski binding which simplifies the shift between ski and crampon usage. Further objectives are that the binding be compact, easy to use, have no loose parts, be rugged and easy to manufacture.

SUMMARY OF THE INVENTION

The subject invention comprises a telemark ski binding which incorporates a crampon. The binding comprises a harness which attaches to a ski boot and an attachment assembly which attaches to the ski. The harness comprises a toe assembly which fits onto the toe of the ski boot and a heel holding assembly which is pivotally connected to the toe assembly and extends around and engages the ski boot heel to hold the harness in place on the boot. The toe assembly comprises a fitting which further comprises a metal sheet portion which fits closely against the sole of the boot in the toe area. Four sharp pointed posts are fastened to the metal sheet portion and extend downward, i.e. vertically away from the sole of the boot and the metal sheet portion. There is a groove in each post near the post's point of attachment to the metal sheet. The posts are positioned at the comers of a rectangular plan form with the axis of the rectangle parallel to the long axis of the sole. The harness with the posts functions as a crampon.

The attachment assembly has two latch bars, one fixed and one slidable and spring loaded. To attach the ski to the boot, with the boot tilted heel-up, the two posts nearest the toe end of the boot are inserted into the attachment assembly to engage the grooves in those two posts with the fixed latch bar. Then the boot is rocked heel downward so that the other two posts engage the other latch bar and move it by cam action until the grooves are positioned to allow the slidable latch bar to move into the grooves in those posts, completing the attachment of the ski to the boot. To remove the ski and expose the crampon, a lever operated cam in the forward end of the attachment assembly moves the slidable latch bar against the spring force to unlatch the posts engaging that bar, allowing the boot to rotate heel upward so that the forward posts can be moved free of the fixed latch bar, freeing the ski from the boot.

The invention is described in more detail below, with reference to the attached drawings.

BRIEF DESCRIPTION OF THE DRAWINGS

FIG. 1 illustrates a lower portion of a ski boot attached to a ski by the subject invention.

FIG. 2 is similar to FIG. 1 with the ski boot removed and showing the subject invention attached to a ski.

FIG. 3 is a bottom view of the toe assembly of the crampon assembly.

FIG. 3A is a bottom view of an alternate toe assembly embodiment.

FIG. 4 is a view showing the attachment assembly from above.

FIG. 5 is a view showing the attachment assembly from the bottom.

FIG. 6 is a schematic of posts and latch bars showing the sequence engagement/disengagement.

DETAILED DESCRIPTION OF THE INVENTION

Figure 7:
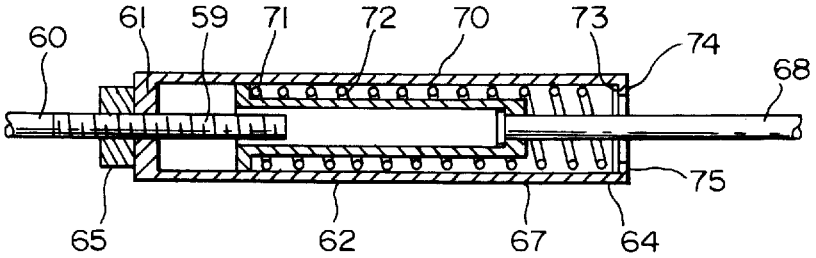
FIG. 7 is a section taken at 7—7 in FIG. 2.

The subject invention is a ski binding which incorporates a crampon which is exposed and ready for use once the ski bound by the binding is removed. FIG. 1 illustrates the subject binding 10 binding ski boot 11 to ski 12. The toe 13 of the boot is engaged in assembly 14 and held engaged by assembly 15 which wraps around and engages heel 16 of the boot. Assembly 17, comprising assemblies 14 and 15, is termed the crampon assembly for purposes of this disclosure. Binding 10 comprises the crampon assembly and attachment assembly 18.

FIG. 2 is the ski and binding of FIG. 1 with the boot removed. The crampon assembly engages attachment assembly 18 which is attached to the ski. Posts, post 19 being typical, extending from sheet portion 20 of fixture 21 of assembly 14 engage latch bars 22 and 23 of the attachment assembly. FIG. 3 is a bottom view of assembly 14, comprising fixture 21 and the posts. In this embodiment the posts are conical and have peripheral grooves near their bases, groove 24 on post 19 being typical. As explained below, the latch bars engage these grooves to attach the crampon assembly to the attachment assembly and ski and are disengaged from the grooves to disengage the attachment assembly and ski from the crampon assembly. FIG. 3A illustrates an alternate post embodiment. The posts, post 25 being typical, are punched out of sheet portion 20' and bent 90° to the surface of the sheet portion. Notches, notch 26 being typical, are machined into the posts. The attachment of the posts in this embodiment is inherent in the manufacture.

FIG. 4 is a partly exploded view from the top of the attachment assembly. Latch bar 23 is attached across frame 27 by fasteners 28 and 29 and latch bar 24 is attached by fasteners 30 and 31 to slider 32 which slides fore and aft in channel 33 in the frame. The attachment assembly is attached to the ski by fasteners inserted through holes 34 and 35 in plate 36, holes 37 and 38 in the plate and holes 39, 40, 41 and 42 in the frame. Holes 34 and 39 accommodate one fastener and holes 35 and 40 accommodate another so that six fasteners in all fasten the attachment assembly to the ski.

FIG. 5 is a view of the attachment assembly from the bottom. Compression spring 43 in slot 44 in slider 32 urges latch bar 24 toward latch bar 22 for purposes described below. End 45 of the spring contacts end 46 of slot 45 and end 47 of the spring contacts bridge 48 of the frame. The thickness of a portion of the slider bar is reduced to allow it to move under the bridge. Lever 49, installed in slot 50 in end 51 of the frame is pivoted to the frame at 52 and shaped so that moving the lever from the solid line position of the phantom line position moves the slider against the force of the spring to increase the distance between the latch bars a distance slightly greater than the depth of the grooves in the posts. As explained below, this increased distance allows the crampon assembly to be positioned relative to the attachment assembly such that when the lever is returned to its solid line position the latch bars will engage the grooves of the posts and lock the crampon assembly to the attachment assembly and therefore the ski. Moving lever 49 to its phantom line (release) position allows removal of the attachment assembly and ski from the crampon assembly and the crampon assembly is ready for use. The crampon assembly, attachment assembly and ski are removable from the boot by releasing the crampon assembly from the boot.

FIG. 6 illustrates schematically the engagement/disengagement sequence of two latch bars 53 and 54 and two posts 55 and 56 attached to crampon assembly plate 20". In view A groove 57 on post 55 is engaging latch bar 53. In view B the crampon assembly plate has been rotated to put post 56 in position relative to latch bar 54 such that the distance between the latch bars is at its maximum. In view C the plate has been moved to allow bar 54 to move into groove 58 in post 56, completing the attachment of the attachment assembly to the crampon assembly.

It is considered to be understandable from this description that the subject invention meets its objectives. It provides a ski binding which simplifies shifting between ski and crampon usage. The binding is compact and easy to use, has no loose parts, is rugged and also easy to manufacture.

It is also considered to be understood that while certain embodiments of the subject invention are described herein, other embodiments and modifications of these described are possible within the scope of the invention which is limited only by the attached claims.

I claim:

1. A ski binding for detachably attaching a ski to a ski boot, said binding comprising:

a harness and an attachment assembly, said harness being detachably attached to a sole of said boot, said attachment assembly being attached to said ski, said harness further comprising a metal plate adapted to be positioned below a toe portion of said boot and a plurality of posts having sharp tapered ends, said posts being attached to said plate with said sharp tapered ends extending downwardly away from said plate, such that said harness functions as a crampon, said posts being adapted for engagement by said attachment assembly, said attachment assembly including two longitudinally spaced latch bars, said latch bars being longitudinally adjustable for movement between a latched position for engaging recessed portions within at least two longitudinally spaced posts positioned between said latch bars and a release position for allowing disengagement of said posts from said attachment assembly such that when said posts are engaged by said attachment assembly said ski is attached to said boot and when said posts are disengaged from said attachment assembly said ski is removed from said boot and said harness can function as a crampon.

* * * * *